US009649241B2

(12) United States Patent
Cox et al.

(10) Patent No.: US 9,649,241 B2
(45) Date of Patent: May 16, 2017

(54) FOLDABLE CASKET LID

(71) Applicant: Vandor Corporation, Richmond, IN (US)

(72) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 15/177,145

(22) Filed: Jun. 8, 2016

(65) Prior Publication Data

US 2016/0354270 A1 Dec. 8, 2016

Related U.S. Application Data

(60) Provisional application No. 62/172,644, filed on Jun. 8, 2015.

(51) Int. Cl.
*A61G 17/02* (2006.01)
*A61G 17/007* (2006.01)

(52) U.S. Cl.
CPC ..... *A61G 17/02* (2013.01); *A61G 17/007* (2013.01); *A61G 17/0073* (2013.01); *A61G 17/0076* (2013.01)

(58) Field of Classification Search
CPC .. A61G 17/02; A61G 17/007; A61G 17/0073; A61G 17/0076; B65D 9/32; B65D 9/34
USPC ..... 27/2, 4, 6, 7, 14, 16; 217/56, 57, 65, 13
See application file for complete search history.

(56) References Cited

U.S. PATENT DOCUMENTS

| | | | | | |
|---|---|---|---|---|---|
| 1,451,009 | A * | 4/1923 | Charlesworth | A61G 17/00 | 27/14 |
| 5,775,061 | A * | 7/1998 | Enneking | A61G 17/00 | 53/445 |
| 6,145,175 | A * | 11/2000 | Enneking | B65D 5/68 | 27/19 |
| 7,003,855 | B2 * | 2/2006 | Lew | A61G 17/00 | 27/14 |
| 8,595,908 | B2 * | 12/2013 | Cox | A61G 17/02 | 16/439 |
| 9,056,040 | B2 * | 6/2015 | Gesell | A61G 17/0073 | |
| 2014/0026378 | A1 * | 1/2014 | Gessel | A61G 17/0073 | 27/4 |

* cited by examiner

*Primary Examiner* — William Miller
(74) *Attorney, Agent, or Firm* — Maginot, Moore & Beck LLP

(57) ABSTRACT

A casket and lid combination includes a casket body and a lid. The casket body has an interior defined by a bottom, pair of opposing side walls and a pair of opposing end walls arranged perpendicular to said side walls, the side walls and end wall extending upwardly from the bottom. The lid covers the interior when installed, and includes a top, a first side extending downwardly from the top, and second side extending downwardly from the top opposite the first side, at least one end extending downwardly from the top perpendicular to the first side and the second side, a first hinge for attaching the first side to the top, and a second hinge for attaching the second side to the top. When the end is not attached to the lid, the first side and second side may be folded inwardly toward a centerline of the top such that the top may be place directly on the casket body with the folded in sides located within the interior of the casket body.

20 Claims, 6 Drawing Sheets

FOLDABLE CASKET LID

This application claims the benefit of priority of U.S. provisional application Ser. No. 62/172,644 filed on Jun. 8, 2015, the disclosure of which is herein incorporated by reference in its entirety.

FIELD OF THE INVENTION

The present invention relates generally to caskets, and more particularly, to lids for caskets.

BACKGROUND OF THE INVENTION

Caskets and cremation containers are constructed from a plurality of materials, including wood, metal, and paper materials, as well as combinations of the foregoing. These caskets and cremation containers vary substantially in price. While wood and metal-based caskets can be expensive, paper-based cremation containers can provide a viable low cost option when cremation is contemplated. However, when paper-based cremation containers are not desired or appropriate, lower cost, simplified wood designs can be implemented.

While simple wooden caskets are typically considered to be an economical approach the storage of the deceased, a significant cost nevertheless arises as a result of shipping and storage costs. Paperboard caskets can be folded and thus may be shipped and stored flat. However, caskets made of rigid material (wood, particle board, etc.) having structural thickness that is not foldable must normally be shipped fully assembled.

Accordingly, there is a need for a casket made from wooden (or other rigid material) that can be shipped and/or stored more economically.

BRIEF SUMMARY OF THE INVENTION

The inventions described herein have several aspects, each of which individually addresses on or more of the problems of the prior art discussed above, and/or other problems or shortcomings not specifically mentioned, but which will become readily apparent to those of ordinary skill in the art by reference to the following detailed description and accompanying drawings.

A first embodiment is a casket and lid combination that includes a casket body and a lid. The casket body has an interior defined by a bottom, pair of opposing side walls and a pair of opposing end walls arranged perpendicular to said side walls, the side walls and end wall extending upwardly from the bottom. The lid covers the interior when installed, and includes a top, a first side extending downwardly from the top, and second side extending downwardly from the top opposite the first side, at least one end extending downwardly from the top perpendicular to the first side and the second side, a first hinge for attaching the first side to the top, and a second hinge for attaching the second side to the top. When the end is not attached to the lid, the first side and second side may be folded inwardly toward a centerline of the top such that the top may be place directly on the casket body with the folded in sides located within the interior of the casket body.

Another embodiment is a casket including a body having a length and a width. The body includes a bottom, a first side wall extending upwardly from the bottom along the length, an opposing second side wall extending upwardly from the bottom, a first end wall extending upwardly from the bottom along the width and an opposing second end wall extending upwardly from the bottom along the width, the bottom, side walls and end walls defining an interior of the body. The casket also includes a lid arranged and constructed to cover the interior of the body. The lid includes a top board, a first side board rotatably coupled to the top board, a second side board arranged opposite the first inclined side board and rotatably coupled to the top board, a third side board rigidly coupled at an angle to the first inclined side board, a fourth side board rigidly coupled to the second inclined side board at an angle, at least one end member removably fastened to the lid. When the at least one end member is removed from the lid, the first, second, third and fourth side boards are configured to rotate inward toward a centerline of the top board such that the lid can fit lengthwise within the interior of the body.

The above described features and advantages, as well as others, will become more readily apparent to those of ordinary skill in the art by reference to the following detailed description and accompanying drawings.

DETAILED DESCRIPTION

Figure 1:
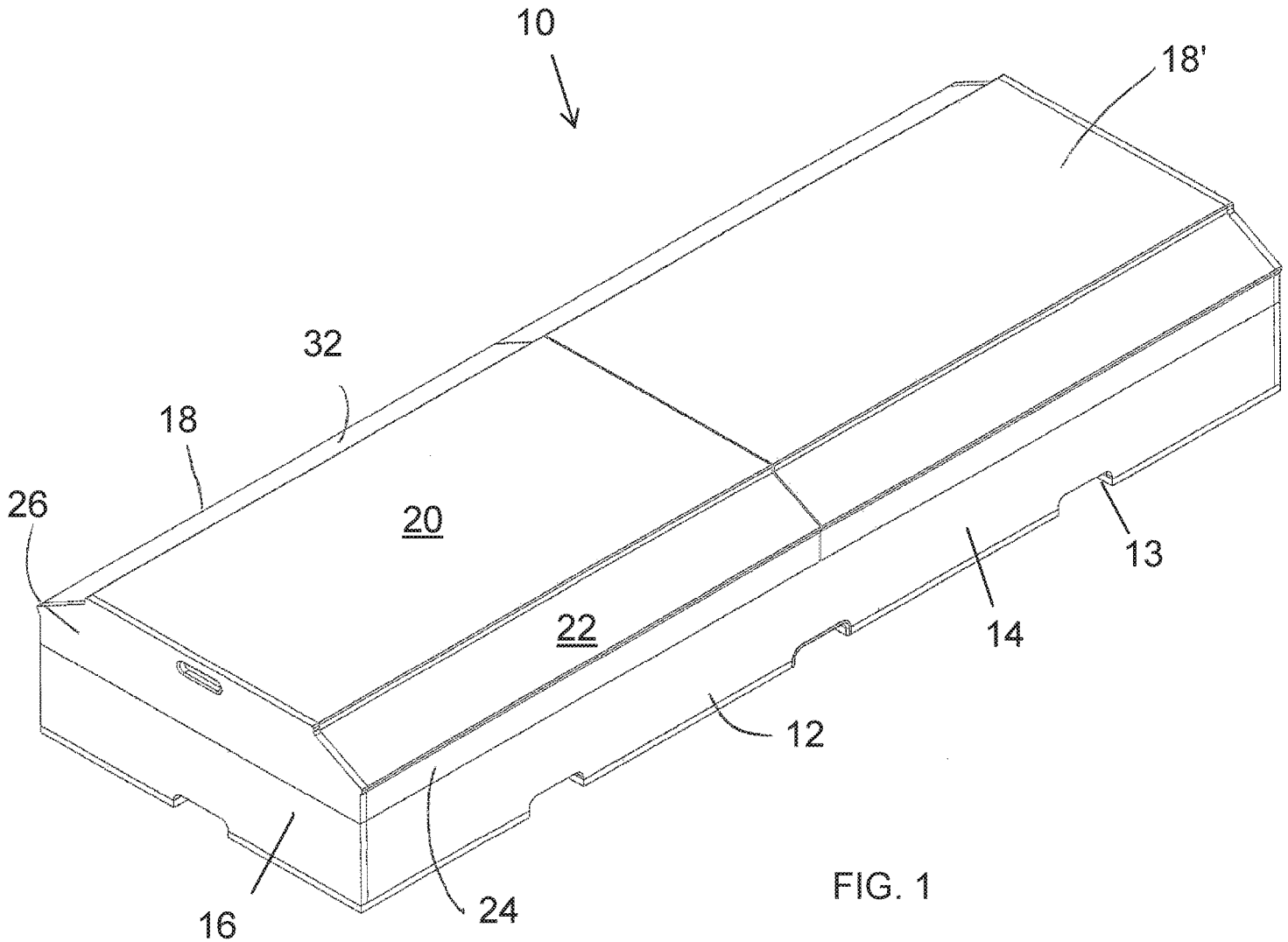
FIG. 1 shows a perspective view of a casket arrangement according to a first embodiment.

FIG. 1 shows a perspective view of a first embodiment of a casket according to the invention. The casket 10 includes a body 12 having a length and a width, the body 12 comprising a bottom 13, a first side wall 14 extending upwardly from the bottom 13 along the length, an opposing second side wall 15 (not shown in the figures) extending upwardly from the bottom 13, and opposing first 16 and second 17 (not shown) end walls extending upwardly from bottom 13 along the width. The bottom 13, side walls 14, 15 and end walls 16, 17 define an interior 11 of body 12. Casket 10 further includes a lid 18, 18'. The lid 18, 18' comprises two substantially identical halves 18, 18' in this embodiment. However, it will be appreciated that the structure of one of the halves (e.g. lid 18) may be extended to cover the entire body 12.

The lid 18 includes five boards 20, 22, 24, 32, 34, an end member 26 and another end member identical to the end member 26, not shown in FIG. 1. The five boards extend the length of the lid 18, which in this embodiment is a portion of the casket body length. The lid 18 in this embodiment is arranged to include a substantially trapezoidal shape in cross section. The boards 20, 22, 24, 32 and 34 (see FIG. 2) are formed of wood, or particle board, or some other structurally stiff material, such as plastic or metal. The end member 26 is formed of two boards disposed adjacent to one another, as shown in FIG. 2.

Figure 2:
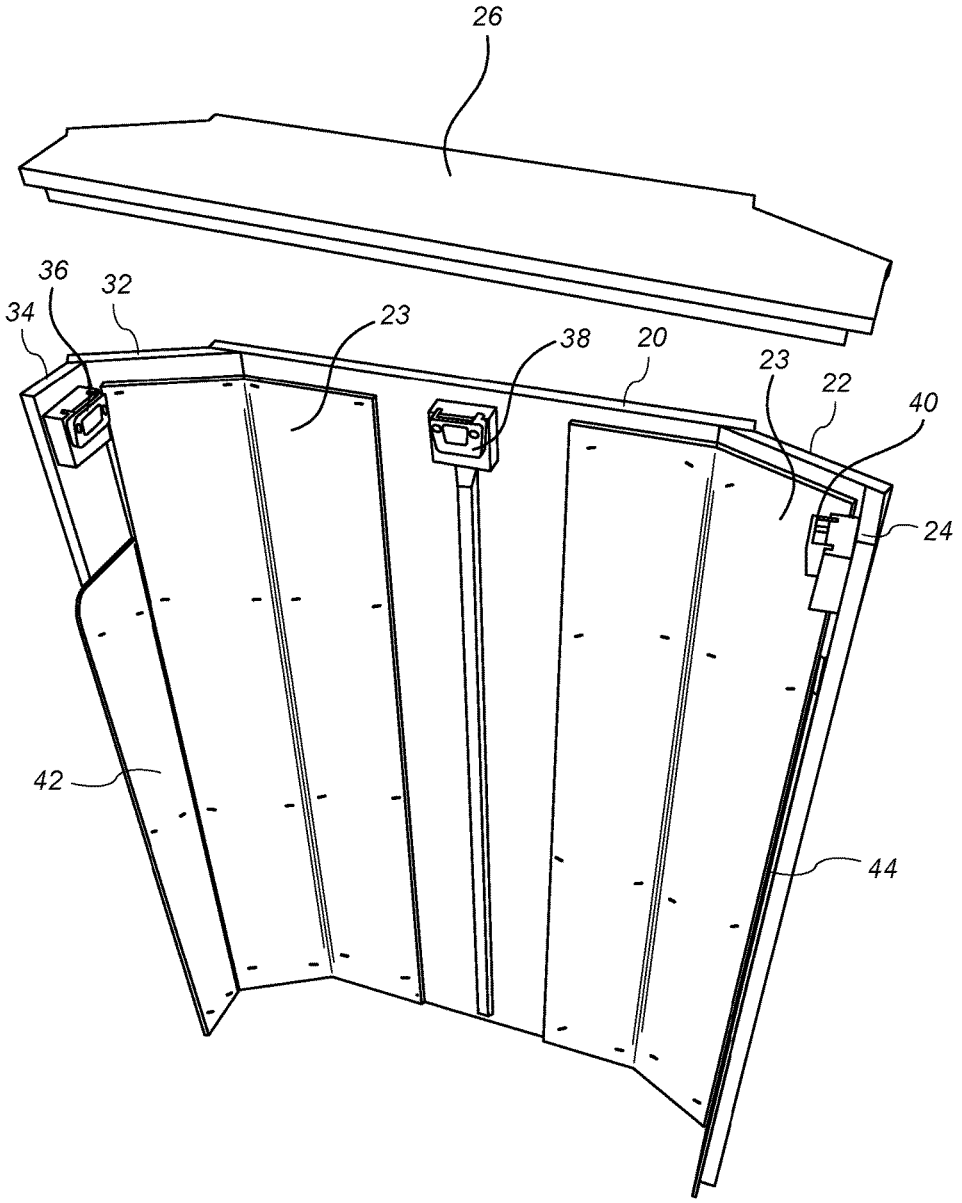
FIG. 2 shows a perspective underside view of a lid of the casket arrangement of FIG. 1, wherein the lid is folded for use as a casket lid.

FIG. 2 shows a portion of the lid 18 with the end member 26 removed. As shown in FIG. 2, the top board 20 is rotatably coupled to inclined side boards 22, 32. In this embodiment, the sideboards 22, 32 are rotatably coupled to the top board by respective hinges 23. The hinges 23 are preferably constructed of a corrugated material such as corrugated card board. The corrugated material of this disclosure is not limited to card board and may include any material that is suitable to create a hinge that is both flexible and of sufficient strength to serve the purpose of a hinge as would be understood by one of ordinary skill in the art. Each hinge 23 is affixed to the top board 20 and to its corresponding inclined side board 22, 32. The hinges 23 may be affixed by any suitable means as would be understood by one of ordinary skill in the art, including but not limited to staples, tacks, glue, screws, and nails. Each inclined side board 22, 32 is rigidly coupled on its other side to a respective vertical board 24, 34.

It will be appreciated that although a single hinge 23 is used for each side board 22, 32, each of the side boards 22, 32 may be coupled using multiple hinges of a similar structure. Likewise, although the hinge 23 runs substantially (at least 90% of) the length of each side board 122, 124, one or more hinges of different lengths may be used.

Figure 3:
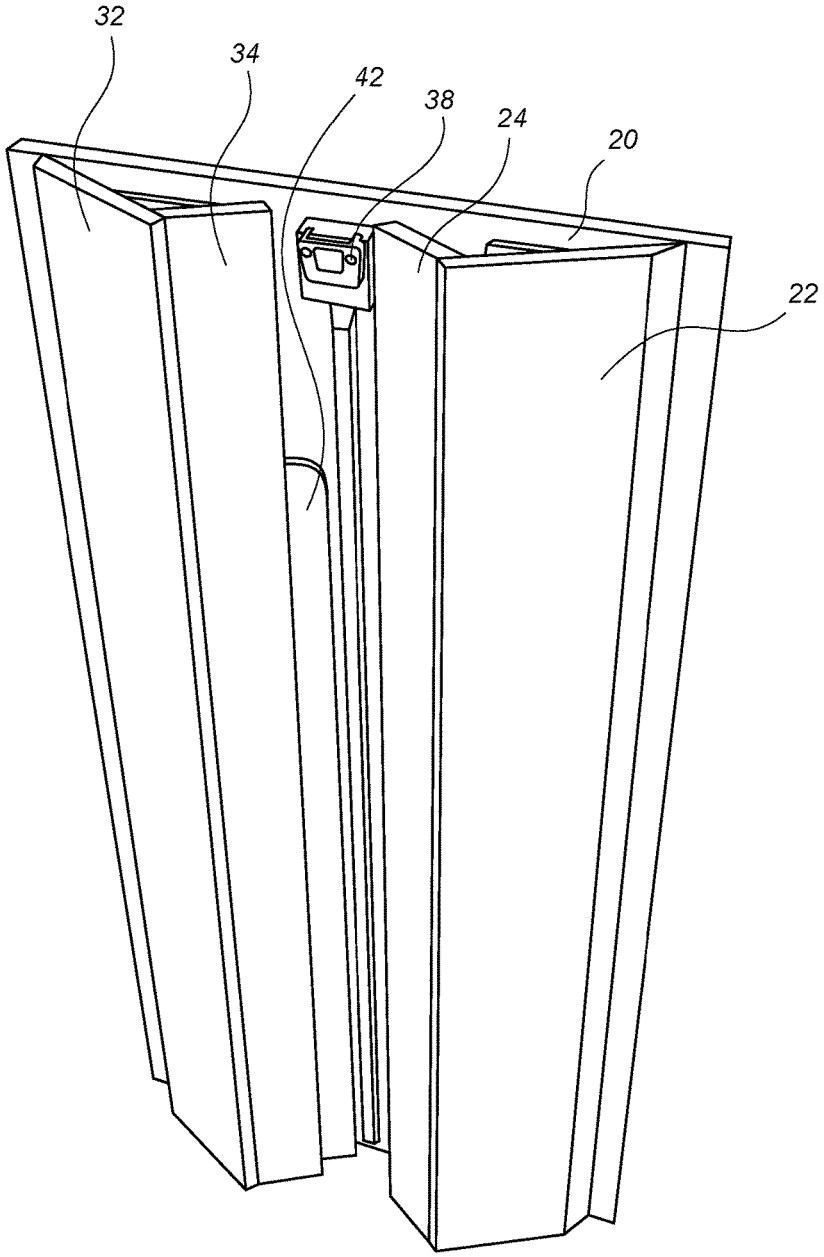
FIG. 3 show a perspective underside view of the lid of FIG. 2 collapsed or folded in for placement within the casket body of the casket of FIG. 1.

As shown in FIG. 3, the hinges 23 allow the inclined side boards 22, 32 and the attached corresponding vertical boards 24, 34 to be rotated or folded inward. In the position shown in FIG. 3, the width of the collapsed lid 18 is small enough such that the lid 18 (minus the end piece 26 and its opposite) can fit within the body 12. Moreover, with the end pieces 26 removed, the length of the lid 18 in the case of the full-length lid can fit lengthwise. The end pieces 26 may also be placed in the interior 11 of the body 12.

The end member 26 (and its opposing counterpart) includes three fasteners, which take the form of part of plastic buckle or clasp, not shown. The fasteners are received by corresponding fastener parts 36, 38, and 40, which are located on the top board 20 and the vertical boards 24, 34. It should be understood that the scope of this disclosure is not limited to the number and type of fastener shown, as end member 26 may be fastened to lid 18 using any appropriate type and number of fastener that provides the ability to conveniently remove end member 26 from lid 18 as would be understood by one of ordinary skill.

When fastened, the boards 20, 22, 24, 32, 34 are secured in the shape shown in FIG. 1 for use with a casket. In this shape, the bottoms of the vertical boards 24, 34 (and the end piece 26 rest on the top of the sides of the casket body 12. Referring to FIG. 2, the lid 18 includes registration fins 42, 44 extending downward along and from inside surface of the vertical boards 24, 34. In this embodiment, the registration fins 42, 44 are also formed from a corrugated material and fastened to the boards 24, 34 by any suitable means. When the lid 18 is assembled onto the casket body 12, the fins 42, 44 fit inside the walls of the casket body 12 and assist in holding the lid 18 in registration over the interior of the casket body 12. It should be understood that fins 42, 44 do not have to be constructed of a corrugated material, but may be arranged and constructed from any suitable material consistent with the purpose of this disclosure.

When the fasteners of the end piece 26 and its counterpart are unfastened, the end piece 26 (and its counterpart) are removed and the boards 20, 22, 24, 32, 34 may be folded in as shown in FIG. 3. As discussed above, when folded in, the lid assembly 18 may be stowed within the casket body 12 for shipping or storage.

Figure 4:
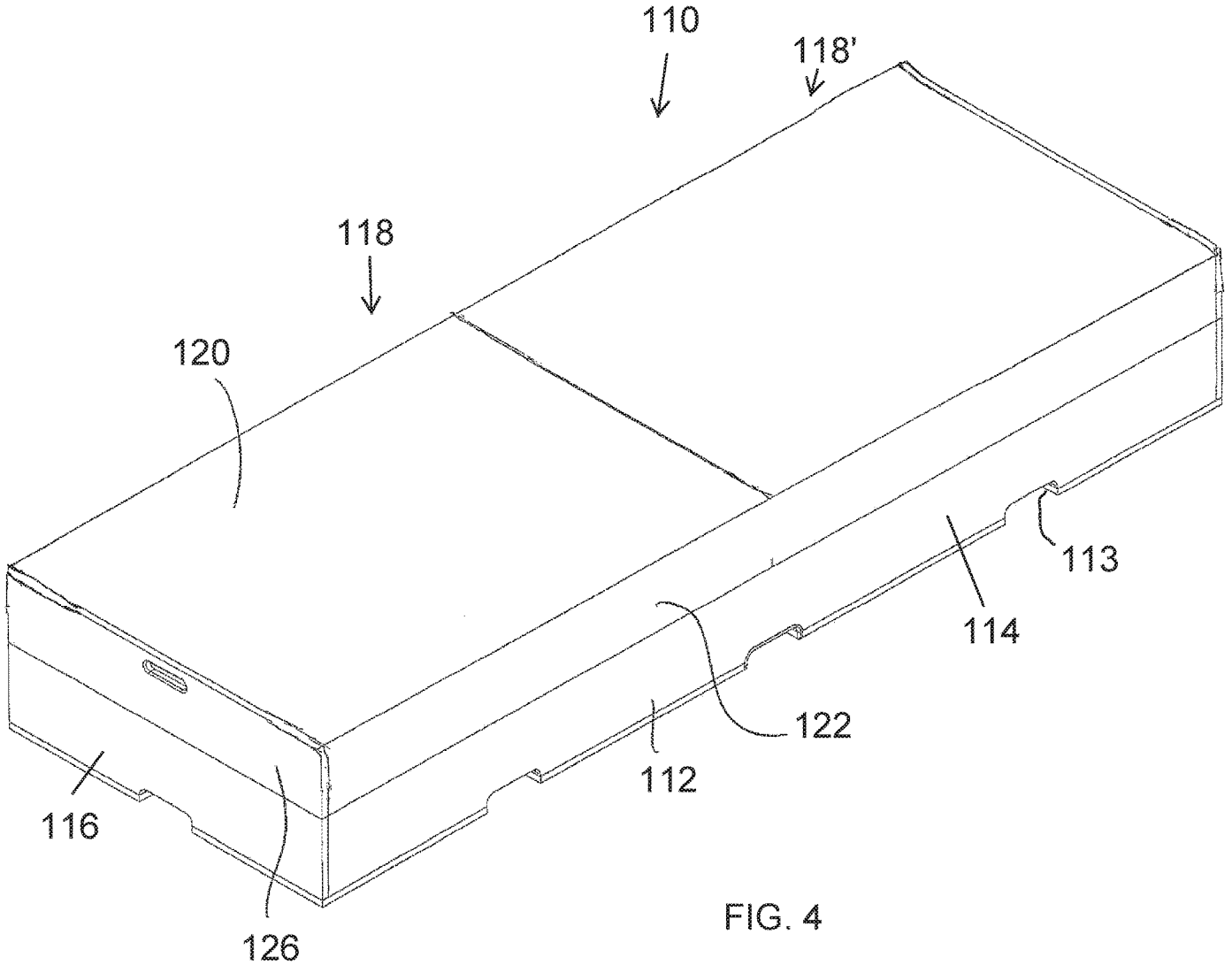
FIG. 4 shows a perspective view of a casket arrangement according to a second embodiment.

FIG. 4 shows an exploded view of a second embodiment of a casket 110 according to the invention. The casket 110 includes a body 112 having a length and a width, the body 112 comprising a bottom 113, a first side wall 114 extending upwardly from the bottom 113 along the length, an opposing second side wall 115 (not shown) extending upwardly from the bottom 113, and opposing first 116 and second 117 (not shown) end walls extending upwardly from bottom 113 along the width. The bottom 113, side walls 114, 115 and end walls 116, 117 define an interior 111 of body 112. Casket 110 further includes a lid 118, 118'. The lid 118 comprises three boards 120, 122, 124 (see FIG. 5), an end member 126 and another end member identical to the end member 126, not shown in FIG. 4. The three boards extend the length of a portion of the casket 110, such that one or more lid pieces having the general structure of the lid 118 may be used to cover the entire casket body 112. The lid 118 in this embodiment is arranged to have a simple box-like shape. The boards 120, 122, 124 (see FIG. 5) are formed of wood, or particle board, or some other structurally stiff material, such as plastic or metal.

Figure 5:
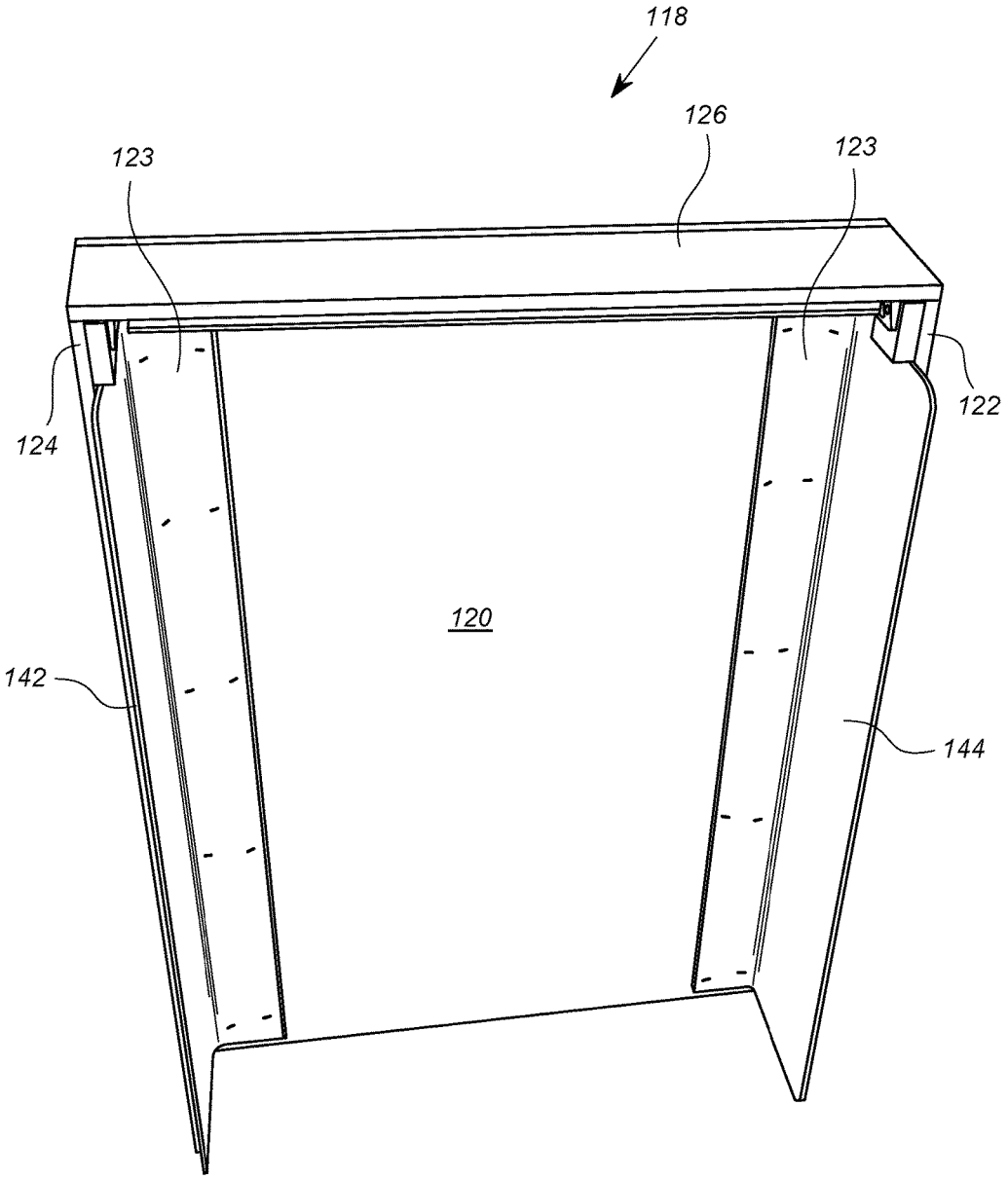
FIG. 5 shows a perspective underside view of a lid of the casket arrangement of FIG. 4, wherein the lid is folded for use as a casket lid.

FIG. 5 shows a portion of the lid 118 with the end member 126 installed. As shown in FIG. 5, the top board 120 is rotatably coupled to vertical side boards 122, 124. In this embodiment, the top board 120 is rotatably coupled to the vertical side boards by respective hinges 123. The hinges 123 are preferably constructed of a corrugated material such as corrugated card board. The corrugated material of this disclosure is not limited to card board and may include any material that is suitable to create a hinge that is both flexible and of sufficient strength to serve the purpose of a hinge as would be understood by one of ordinary skill in the art. Each hinge 123 in this embodiment is affixed to the top board 120 and to its corresponding vertical side board 122, 124. The hinges 123 may be affixed by any suitable means as would be understood by one of ordinary skill in the art, including but not limited to staples, tacks, glue, screws, and nails. It will be appreciated that although a single hinge 123 is used for each vertical side board 122, 124, each of the vertical side boards 122, 124 may be coupled using multiple hinges of a similar structure. Likewise, although the hinge 123 runs substantially the length of each vertical side boards 122, 124, one or more hinges of different lengths may be used.

Figure 6:
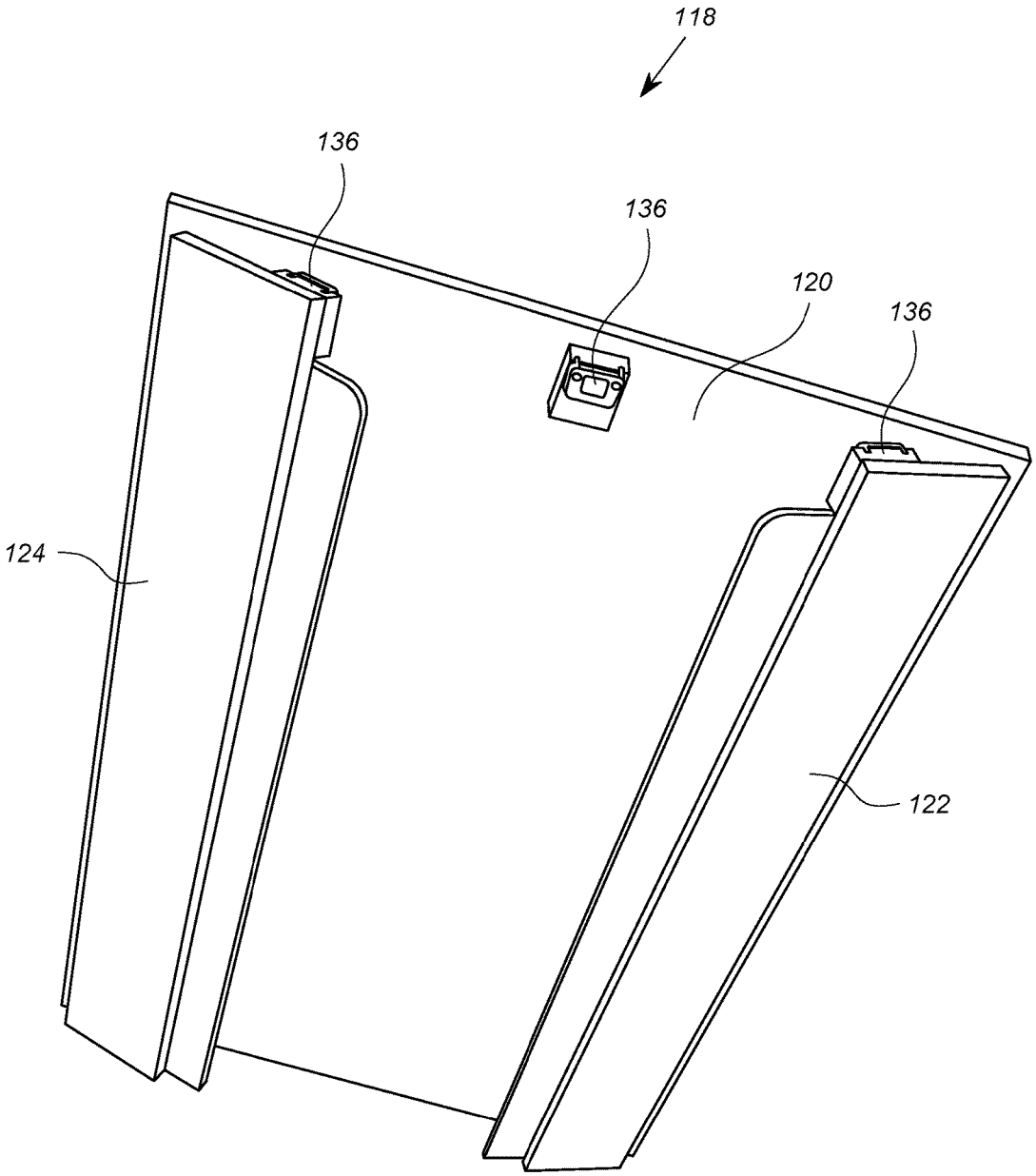
FIG. 6 show a perspective underside view of the lid of FIG. 5 collapsed or folded in for placement within the casket body of the casket of FIG. 4.

As shown in FIG. 6, the hinges 123 allow the vertical side boards 122, 124 to be rotated or folded inward. In the position shown in FIG. 6, the top board 120 may be placed directly on the casket body 112 with the folded-in vertical side boards 122, 124 inside the interior.

The end piece 126 (and its opposing counterpart) includes in this embodiment three fasteners, which take the form of part of plastic buckle or clasp. The fasteners are received by corresponding fastener parts 136 which are located on the top board 20 and the vertical boards 122, 124. It should be understood that the scope of this disclosure is not limited to the number and type of fastener shown, as end member 126 may be fastened to lid 118, 118' using any appropriate type and number of fasteners that provides the ability to conveniently remove end member 126 from lid 118, 118' as would be understood by one of ordinary skill.

When fastened, the boards 120, 122, 124 are secured in the shape shown in FIG. 4 for use with a casket. In this shape, the bottoms of the vertical boards 122, 124 (and the end piece 126) rest on the top of the sides of the casket body 112. Referring to FIG. 5, the lid 118 includes registration fins 142, 144 extending downward along and from inside surface of the vertical boards 122, 124. In this embodiment, the registration fins 142, 144 may be formed from the same corrugated material that forms the corresponding hinge 123. For example, the registration fin 142 may form an extension of one hinge 123, and the registration fin 144 may form an extension of the other hinge 123. When the lid 118 is assembled onto the casket body 112, the fins 142, 144 fit inside the walls of the casket body 112 and assist in holding the lid 118 in registration over the interior of the casket body 112. It should be understood that fins 142, 144 do not have to be constructed of a corrugated material, but may be arranged and constructed from any suitable material consistent with the purpose of this disclosure.

When the fasteners on the end piece 126 and its counterpart are unfastened, the end piece 126 (and its counterpart) are removed and the boards 120, 122, 124 may be folded in as shown in FIG. 6. As discussed above, when folded in, the underside surface of the top board 120 sits atop the casket body sides. As a consequence, the folded in boards 122, 124 are located in the interior of the casket body 112, and the casket body 112 and lid 118 have a much lower profile for shipping or storage.

It will be appreciated that the above described embodiments are merely illustrative, and that those of ordinary skill in the art may readily devise their own modifications and implementations that incorporate the principles of the present invention and fall within the spirit and scope thereof. For example, it will be appreciated that each of the embodiments illustrated above may be adapted to lids having other shapes, and other numbers of sides. It will be appreciated that other materials may be used for the hinges, and that multiple smaller hinges may be used to connect adjacent boards. Those skilled in the art will appreciate that many modifications are possible in the example embodiments without materially departing from this invention. Accordingly, all such modifications are intended to be included within the scope of this disclosure.

Moreover, in reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A casket comprising:

a body having a length and a width, the body further having a bottom, a first side wall extending upwardly from the bottom along the length, an opposing second side wall extending upwardly from the bottom, a first end wall extending upwardly from the bottom along the width and an opposing second end wall extending upwardly from the bottom along the width, the bottom, side walls and end walls defining an interior of the body;

a lid arranged and constructed to cover the interior of the body, the lid comprising a top board, a first inclined side board rotatably coupled to the top board, a second inclined side board arranged opposite the first inclined side board and rotatably coupled to the top board, a third side board rigidly coupled at an angle to the first inclined side board, a fourth side board rigidly coupled to the second inclined side board at an angle, at least one end member removably fastened to the lid;

wherein when the at least one end member is removed from the lid, the first, second, third and fourth side boards are rotatable inward toward a centerline of the top board such that the lid fits lengthwise within the interior of the body.

2. The casket of claim 1 wherein when the at least one end member is fastened to the lid, the top board, the first side board, and the second side board are arranged to include a substantially trapezoidal shape in cross section.

3. The casket of claim 1 wherein the lid further comprises a first registration fin extending downwardly from an inside surface of the third side board and a second registration fin extending downwardly from an inside surface of the fourth side board such that when the lid is installed onto the body the fins fit inside the side walls to assist in holding the lid in registration over the interior of the body.

4. The casket of claim 3 wherein the first and second registration fins are constructed from a corrugated material.

5. The casket of claim 1 wherein the lid comprises two substantially identical halves.

6. The casket of claim 1 wherein the first side board is coupled to the top board via at least a first hinge, and the second side board is coupled to the top board via at least a second hinge.

7. The casket of claim 6 wherein the top board and the first, second, third and fourth side boards are constructed from a material selected from wood, particle board, plastic or metal.

8. The casket of claim 7, wherein the first hinge and the second hinge are constructed from corrugated cardboard.

9. A casket and lid combination comprising:

a casket body having a length and a width, the casket body further having an interior defined by a bottom, pair of opposing side walls and a pair of opposing end walls arranged perpendicular to said side walls, the side walls and end walls extending upwardly from the bottom;

a lid arranged and constructed to cover the interior when the lid is installed on the casket body, the lid comprising a top, a first side extending downwardly from the top, and second side extending downwardly from the top opposite the first side, at least one end removably attached to the lid and extending downwardly from the top perpendicular to the first side and the second side, at least a first hinge for attaching the first side to the top, and at least a second hinge for attaching the second side to the top;

wherein when the at least one end is not attached to the lid, the first side and second side are foldable inwardly toward a centerline of the top such that the top is placed directly on the casket body with the folded in sides located within the interior of the casket body.

10. The casket and lid combination of claim 9 wherein the lid further comprises a first registration fin extending downwardly from an inside surface of the first side and a second registration fin extending downwardly from an inside surface of the second side such that when the lid is installed onto the casket body the fins fit inside the side walls to assist in holding the lid in registration over the interior of the casket body.

11. The casket and lid combination of claim 10 wherein the first registration fin is integrally formed with, and forms an extension of, the first hinge.

12. The casket and lid combination of claim 9 wherein the lid comprises two substantially identical halves.

13. The casket and lid combination of claim 9 wherein the top and sides of the lid are constructed from a material selected from wood, particle board, plastic or metal.

14. The casket and lid combination of claim 13 wherein the first hinge and the second hinge are constructed of a corrugated material.

15. The casket and lid combination of claim 14 wherein the corrugated material is corrugated cardboard.

16. A casket lid for covering an interior of a casket body, the lid comprising:

a top board;

a first inclined side board coupled to the top board via a first hinge;

a second inclined side board arranged opposite the first inclined side board and coupled to the top board via a second hinge;

a first vertical side board rigidly coupled to the first inclined side board;

a second vertical side board rigidly coupled to the second inclined side board; and at least one end member removably fastened to the lid, wherein when the at least one end member is removed from the lid, the inclined side hoards and vertical side boards are foldable inward toward a centerline of the top board such that the lid fits within the interior of the casket body.

17. The casket lid of claim 16 wherein when the at least one end member is fastened to the lid, the lid is arranged to include a substantially trapezoidal shape in cross section.

18. The casket lid of claim 16 wherein the lid further comprises a first registration fin extending downwardly from an inside surface of the first vertical side board and a second registration fin extending downwardly from an inside surface of the second vertical side board such that when the lid is installed onto the casket body, the fins fit inside the interior to assist in holding the lid in registration over the interior of the casket body.

19. The casket lid of claim 16 wherein the hinges are constructed of a corrugated material.

20. The casket lid of claim 19, wherein the corrugated material is corrugated cardboard.

* * * * *